United States Patent [19]

Pratt, deceased et al.

[11] 4,394,849

[45] Jul. 26, 1983

[54] VAPOR GENERATOR HAVING DRAINABLE TUBE BENDS AROUND BURNER OPENINGS EXTENDING THROUGH FURNACE BOUNDARY WALLS FORMED IN PART BY ANGULARLY EXTENDING FLUID FLOW TUBES

[75] Inventors: Harry H. Pratt, deceased, late of West Orange, N.J., by Mary D. Pratt, executrix; William J. Gill, New York, N.Y.

[73] Assignee: Foster Wheeler Energy Corporation, Livingston, N.J.

[21] Appl. No.: 276,122

[22] Filed: Jun. 22, 1981

[51] Int. Cl.[3] ..... F22B 15/00; F22B 25/00; F22B 37/10

[52] U.S. Cl. ..... 122/235 K; 122/6 A; 122/235 A

[58] Field of Search ..... 122/235 A, 235 B, 235 K, 122/235 R, 6 A, 235 C, 51; 165/169

[56] References Cited

U.S. PATENT DOCUMENTS 2,346,715 4/1944 Woodward et al. ..... 122/235 C
3,400,689 9/1968 Bagley et al. ..... 122/510
4,245,588 1/1981 Gill et al. ..... 122/235 A

FOREIGN PATENT DOCUMENTS 1231716 1/1967 Fed. Rep. of Germany ... 122/235 A
2232741 6/1973 France ..... 122/235 R

*Primary Examiner*—Edward G. Favors
*Assistant Examiner*—Steven E. Warner
*Attorney, Agent, or Firm*—Marvin A. Naigur; John E. Wilson; Warren B. Kice

[57] ABSTRACT

A vapor generator in which a plurality of tubes are connected together and arranged to form at least a portion of the boundary walls of a gas-tight enclosure. Portions of the tubes are bent to form a plurality of openings extending through at least one of the boundary walls. Some of the bent tube portions extend around the openings in the plane of the wall, and others of the bent tube portions extend out of the plane of the wall. The tubes, including the bent portions, extend at an angle with respect to a horizontal plane for their entire lengths to enable the tubes to drain. A burner is associated with each opening to apply heat to the enclosure, and fluid is passed through the tubes to apply heat to the fluid.

7 Claims, 7 Drawing Figures

VAPOR GENERATOR HAVING DRAINABLE TUBE BENDS AROUND BURNER OPENINGS EXTENDING THROUGH FURNACE BOUNDARY WALLS FORMED IN PART BY ANGULARLY EXTENDING FLUID FLOW TUBES

BACKGROUND OF THE INVENTION

This invention relates to a vapor generator and, more particularly, to a sub-critical or super-critical once-through vapor generator for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

These arrangements provide several improvements over conventional drum-type boilers, and, although some problems arose in connection with early versions of the once-through generators (such as excessive thermal loses, mismatching of steam temperature, the requirement for sophisticated controls and additional valving during startup) these problems have been virtually eliminated in later generation systems.

In these later arrangements, the walls of the furnace section of the generator are formed by a plurality of vertically extending tubes having fins extending outwardly from diametrically opposed portions thereof, with the fins of adjacent tubes being connected together to form a gas-tight structure. During startup, supercritical water is passed through the furnace boundary walls in multiple passes to gradually increase its temperature. This requires the use of headers between the multiple passes to mix out heat unbalances caused by portions of the vertically extending tubes being closer to the burners than others or by the tubes receiving uneven adsorption because of local slag coverage, burners being out of service, and other causes. The use of these intermediate headers, in addition to being expensive, makes it undesirable to operate the furnace at variable pressure because of probability of separation of the vapor and liquid phases within the header and uneven distribution to the down-stream circuit. Therefore, this type of arrangement requires a pressure reducing station interposed between the furnace outlet and the separators to reduce the pressure to predetermined values and, in addition, requires a relatively large number of downcomers to connect the various passes formed by the furnace boundary wall circuitry.

In U.S. Pat. No. 4,116,168, issued on Sept. 26, 1978, and assigned to the same assignee as the present invention, a vapor generator is disclosed which incorporates the features of the system discussed above and yet eliminates the need for intermediate headers, additional downcomers, and a pressure reducing station. These improvements are achieved at least in part by forming a portion of the boundary walls of the furnace section of the vapor generator by a plurality of interconnected tubes extending at an acute angle with respect to a horizontal plane. According to a preferred embodiment of this arrangement, the tubes of the boundary walls defining the upper and lower portions of the furnace section of the vapor generator extend vertically while the tubes in the intermediate furnace portion extend at an acute angle with respect to a horizontal plane. The latter tubes are in fluid flow registry with the tubes in the lower and upper furnace portions, and wrap around the furnace section for at least one revolution.

This use of angularly extending tubes in the intermediate furnace section enables the fluid to average out furnace heat imbalances and be passed through the boundary walls in one complete pass thus eliminating the use of multiple passes and their associated mix headers and downcomers. As a result, the furnace can be operated at variable pressure and the need for a pressure reducing station is eliminated. Also as a result of the angularly extending tubes, a relatively high mass flow rate together with a large tube size is possible when compared to a vertical tube arrangement.

However, although the use of the angularly extending tubes has apparent advantages, there is a problem associated with their use. In particular, several openings must be formed through the aforementioned intermediate furnace portion of one or more of the boundary walls to accomodate burners. Normally, these openings are formed by simply bending the tubes forming the wall in a manner to define the opening(s). However, when the tubes extend at an acute angle with respect to a horizontal plane, it can be appreciated that a casual bending of the tubes to form the openings can result in a portion or portions of the bent tubes extending substantially horizontal. This can create significant problems since if even a relatively short length of any tube extends substantially horizontal or at an angle downwardly from the horizontal, the tube will not drain properly which could result in a severe curtailment in the operating efficiency of the generator.

SUMMARY OF THE INVENTION

It is, therefore, an object of the present invention to provide a vapor generator which incorporates the features of the arrangements discussed above and yet eliminates the need for intermediate headers, additional downcomers, and a pressure reducing station.

It is a further object of the present invention to provide a vapor generator of the above type in which a portion of the boundary walls of the furnace section of the vapor generator are formed by a plurality of interconnected tubes which extend at an acute angle with respect to a horizontal plane.

It is a further object of the present invention to provide a vapor generator of the above type in which a plurality of burner openings are provided through at least one of the boundary walls and extend through the portion of the boundary walls formed by the angularly extending tubes.

It is a still further object of the present invention to provide a vapor generator of the above type in which the angularly extending tubes forming the boundary wall or walls through which the burner openings are formed, extend in such a manner that no portion or portions of the tubes are disposed horizontally or at an angle downwardly from the horizontal.

It is a still further object of the present invention to provide a vapor generator of the above type in which the tubes forming the furnace boundary walls including those portions of the tubes that are bent to form the burner openings are arranged and constructed in a manner to enable the boundary wall tubes to be drainable.

Toward the fulfillment of these and other objects, the vapor generator of the present invention comprises a plurality of tubes connected together and arranged to form at least a portion of the boundary walls of a gas-tight enclosure. At least one opening extends through at least one of the boundary walls and is formed by bending portions of each tube of a first group of tubes extending around said opening in the plane of said wall. Portions of each tube of a second group of tubes are bent out of the plane of the wall and extend adjacent the tube portions of the first group in proximity to the opening. The arrangement is such that an inner row of tube portions extends around the opening and at least one additional row of tube portions extends radially outward from the first row. The tubes extend at an acute angle with respect to a horizontal plane for the entire lengths of said tubes including the bent tube portions so that water will drain from the tubes. Burner means register with the opening to apply heat to the enclosure, and means are provided for passing fluid through the tubes to apply heat to the fluid.

BRIEF DESCRIPTION OF THE DRAWINGS

The above brief description, as well as further objects, features and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
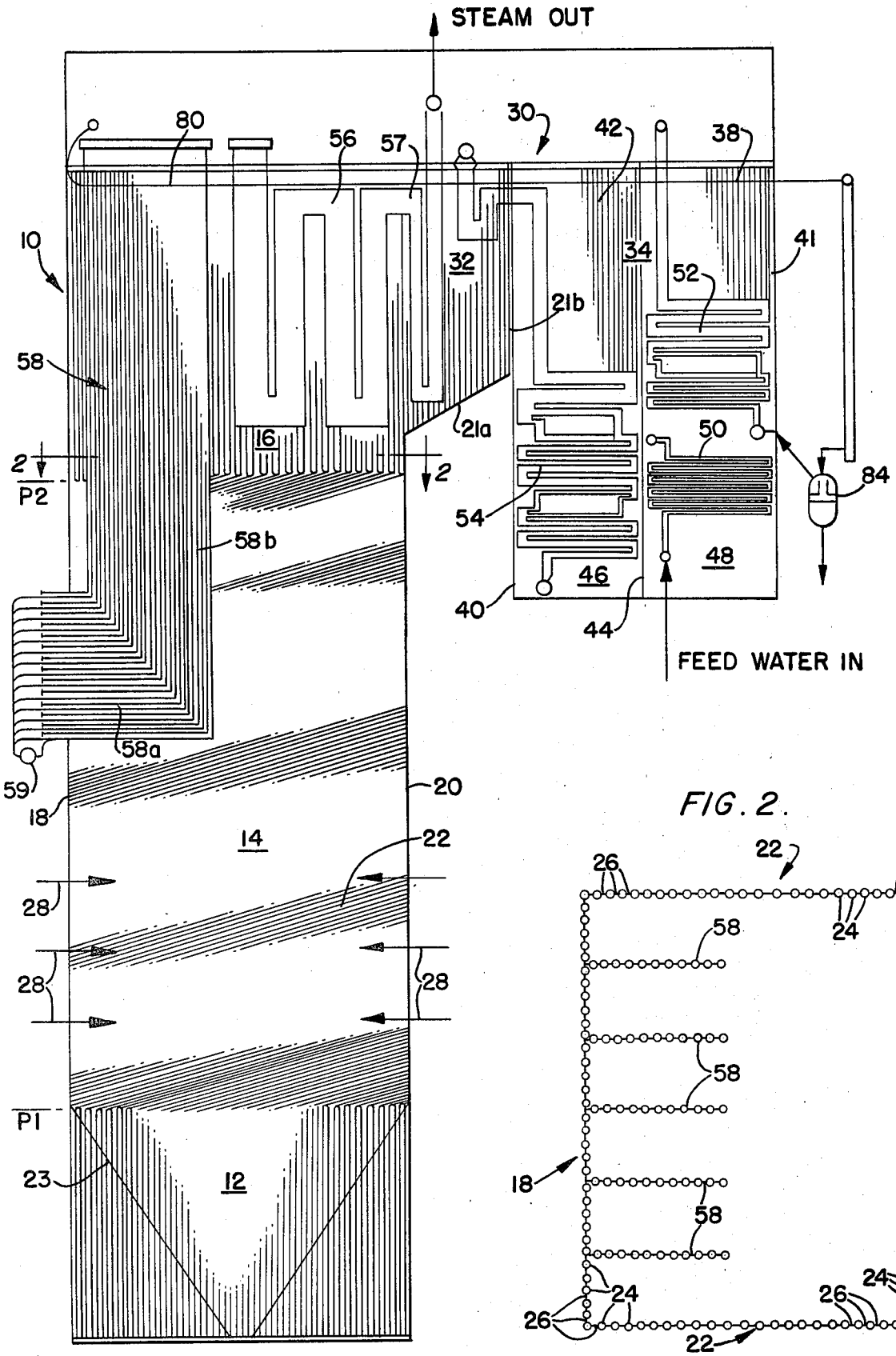
FIG. 1 is a schematic-sectional view of the vapor generator of the present invention.

Referring specifically to FIG. 1 of the drawings, the reference numeral 10 refers in general to the vapor generator of the present invention and includes a lower furnace section 12, an intermediate furnace section 14, and an upper furnace section 16. The boundary walls defining the furnace sections 12, 14 and 16 include a front wall 18, a rear wall 20 and two sidewalls extending between the front and rear walls, with one of said sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
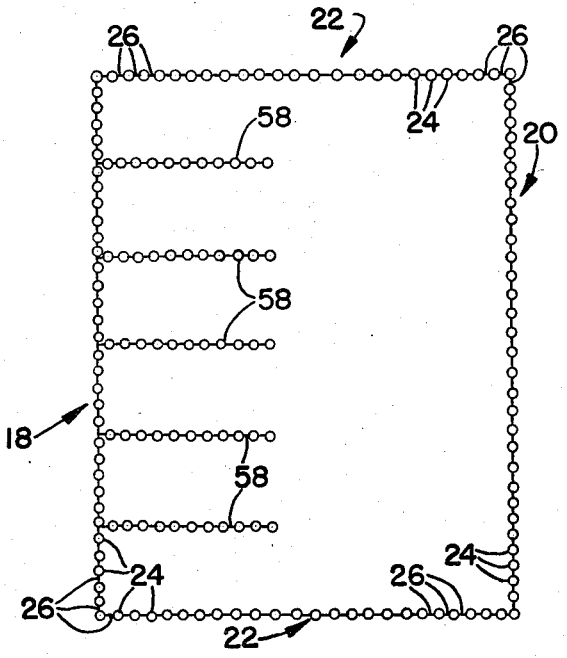
FIG. 2 is a sectional view taken along the line 2—2 of FIG. 1.

As better shown in FIG. 2, each of the walls 18, 20 and 22 are formed of a plurality of tubes 24 having continuous fins 26 extending outwardly from diametrically opposed portions thereof, with the fins of adjacent tubes being connected together in any known manner, such as by welding, to form a gas-tight structure.

Figure 3:
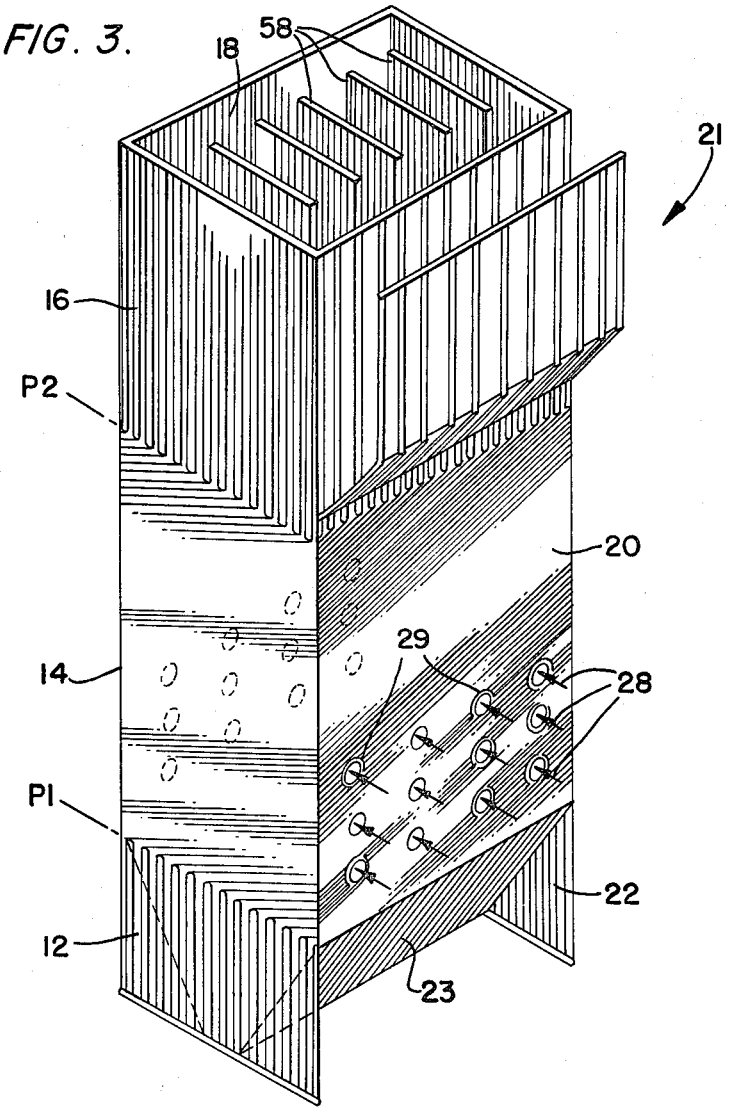
FIG. 3 is a partial, perspective view of a portion of the vapor generator of FIG. 1.

Referring specifically to FIGS. 1 and 3, in the lower furnace section 12 of the tubes 24 in the sidewalls 22, extend from the "floor" or lowest portion of the furnace vertically upwardly to a horizontal plane P1 while the tubes 24 in the front wall 18 and the rear wall 20 are sloped outwardly to form the hopper section 23. The tubes 24 forming the walls 18, 20 and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20 and 22 of the upper furnace section 16 extend vertically from the plane P2 to the top of the latter section with the exception of a portion of the tubes in the rear wall 20 which are bent out of the plane of the latter wall to form a branch wall 21 as will be explained in detail later.

The tubes 24 in the intermediate section 14 extend from plane P1 and wrap around for the complete perimeter of the furnace at least one time to form the corresponding portions of the walls 18, 20 and 22 before they terminate at the plane P2. These tubes 24 also have a plurality of fins 26 which are arranged and which function in an identical manner to the fins of the tubes in the lower furnace section 12 and in the upper furnace section 14.

Although not clear from the drawings, it is understood that each tube 24 in the intermediate furnace section 14 is connected to, and registers with, two tubes 24 in the upper furnace section 16 and with two tubes 24 in the lower furnace section 12, with the connections being made by bifurcates extending between the respective tubes as disclosed in detail in U.S. Pat. No. 4,178,881, issued Dec. 18, 1977 and assigned to the same assignee as the present invention.

As mentioned above, the upper portion of the rear wall 20 in the upper furnace section 16 has a branch wall 21, shown in general in FIG. 3, formed by bending a selected number of tubes 24 from the rear wall 20 outwardly to form an angular portion **21*a* (FIG. 1) and then upwardly to form a vertical portion 21*b*. As a result, spaces are defined between the remaining tubes 24 in the upper portion of the wall 20 as well as between the portions of the tubes forming the vertical portion 21*b* of the branch wall 21. This permits combustion gases to exit from the upper furnace section 16**, as will be described later.

As better shown in FIG. 3, a plurality of burners 28 extend through corresponding openings 29 formed through the front and rear walls 18 and 20 in the intermediate furnace section 14, with the burners being arranged in this example in four vertical rows of three burners per row. The burners 28 are shown schematically since they can be of a conventional design. The manner in which the openings 29 are formed through the walls 18 and 20 will be described in detail later.

Referring again to FIG. 1, a heat recovery area, shown in general by the reference numeral 30, is provided adjacent the upper furnace section 16 in gas flow communication therewith, and includes a vestibule section 32 and convection section 34. The floor of the vestibule section 32 is formed by the angular portion **21*a* of the branch wall 21 with the tubes 24 in this portion being provided with fins which are connected to fins of adjacent tubes to render the floor gas-tight. As stated above, the remaining portions of the tubes 24 forming the vertical portion 21*b* of the branch wall 21 extend in a spaced relation to permit gases to pass from the vestibule section 32 to the convection section 34**.

The convection section 34 includes a front wall 40 the upper portion of which is formed by a plurality of tubes extending in a spaced relationship to permit the gases from the vestibule section 32 to enter the convection section. The heat recovery area 30 also includes a rear wall 41 and two sidewalls 42, with one of the latter being shown in FIG. 1. It is understood that the rear wall 41, the sidewalls 42, and the lower portion of the front wall 40 are formed of a plurality of vertically extending, finned, interconnected tubes 24 in a manner similar to that of the upper furnace section 16.

A partition wall 44, also formed by a plurality of finned, interconnected tubes 24, is provided in the heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule section 32 in direct fluid communication with the platen superheater 56.

The upper end portions of the walls 18, 20 and 22, and the branch wall 21, as well as the partition wall 44, the sidewalls 42 and the rear wall 41 of the heat recovery area 30 all terminate in substantially the same general area in the upper portion of the vapor generating section 10.

As better shown in FIGS. 1 and 2, a plurality of division walls 58 are provided with each having a horizontal portion 58*a* and a vertical portion 58*b*. Each division wall 58 is formed by a plurality of finned interconnected tubes 24 as shown in FIG. 2. Referring again to FIGS. 1 and 3, the horizontal portions 58*a* of each division wall 58 extend from a header 59 located externally and adjacent to the front wall 18 and penetrate the latter wall before they are bent upwardly to form the vertical portions 58*b*. The upper end of each vertical division wall portion terminates in substantially the same general area as the walls 18, 20 and 22.

A roof 80 is disposed in the upper portion of the section 10 slightly below the upper ends of the tubes forming the walls 18, 21*b*, 22, 40, 41 and 44. The roof 80 consists of a plurality of tubes 24 having fins 26 connected in the manner described above but extending horizontally from the front wall 18 of the furnace section 10 to the rear wall 41 of the heat recovery area 30.

Portions of the tubes forming a burner opening 29 in the wall 20 of the intermediate furnace 14 are shown in FIGS. 4–7, with the tubes being referenced consecutively beginning with the number 101 and grouped as shown by the brackets, as an aid in presentation.

Figures 4, 6, 7:
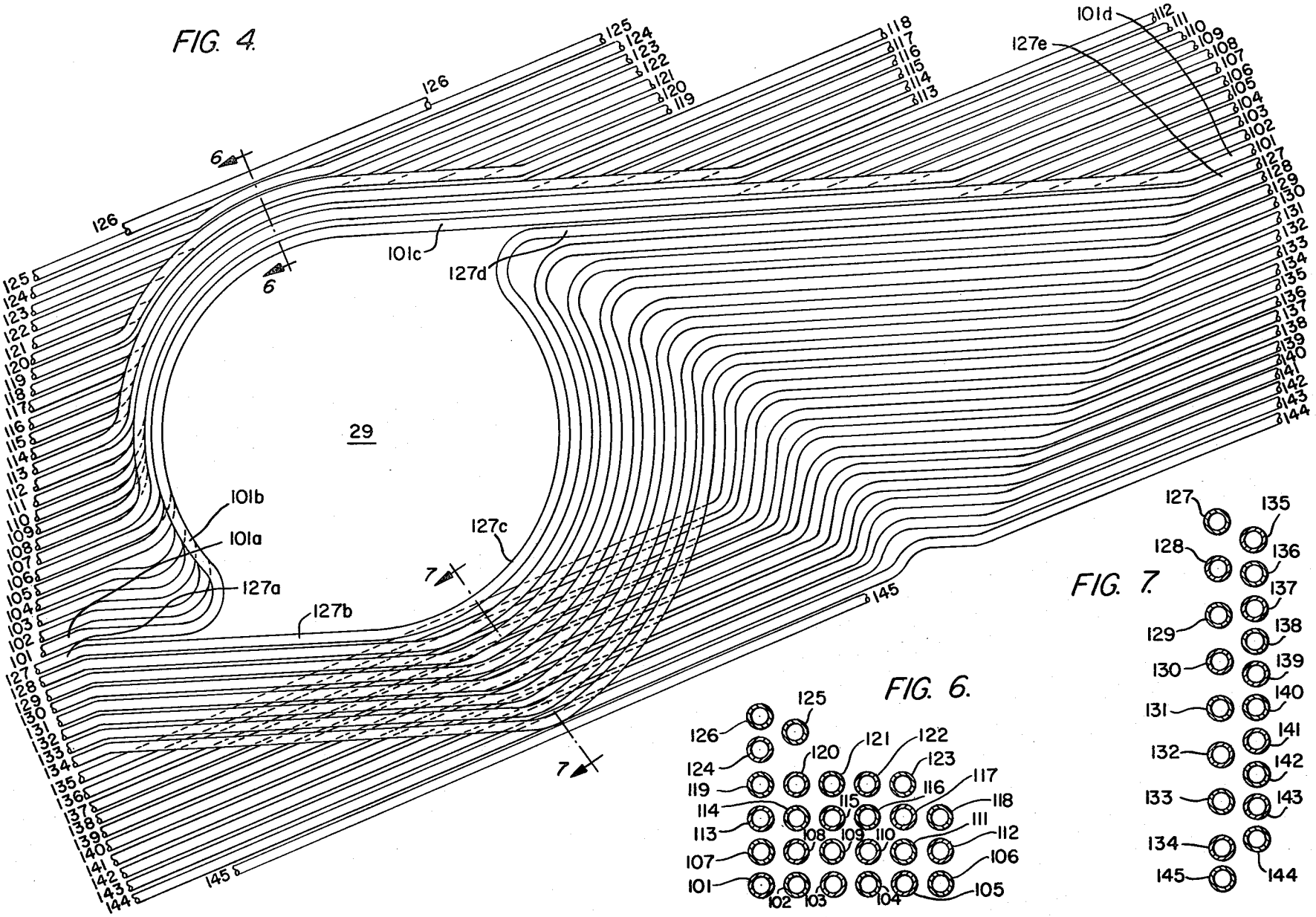
FIG. 4 is an enlarged, partial, front elevational view of a portion of a boundary wall of the vapor generator of FIG. 1.
FIGS. 6 and 7 are cross-sectional views taken along the line 6—6 and the line 7—7, respectively, of FIG. 4.

As shown, tubes 101–126 are bent to define or enclose the left-hand and upper portions of the openings 29 as viewed in FIG. 4, while the tubes 127–145 define the lower and right-hand portions of the opening 29. More specifically, the tube 101 has a portion 101*a* extending in the normal manner, i.e., at a predetermined acute angle with respect to a horizontal plane, a portion 101*b* extending upwardly in a curved configuration, a portion 101*c* extending downwardly at an angle slightly less than the normal angle, and a portion 101*d* extending at the normal angle. Thus, the entire tube 101 extends upwardly from the horizontal in a direction from left-to-right as viewed in FIG. 4 to enable water to drain from the tube in a direction from right-to-left.

Figure 5:
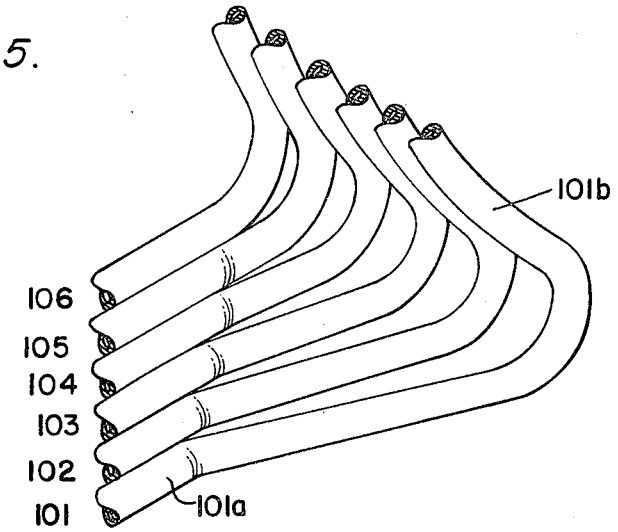
FIG. 5 is a partial enlarged, perspective view of a portion of the tubes forming a boundary wall of the vapor generator of FIG. 1.

Tubes 102–106 which, as indicated by the bracket in FIG. 4, belong to the same "group" as the tube 101, are bent out of the plane of the drawing as viewed in FIG. 4 so as to extend "behind" the tube 101 with the bending being such that tube 102 extends immediately behind tube 101, tube 103 extends immediately behind the tube 102, and so on through the tube 106. This arrangement is shown in FIG. 5 which depicts the left-hand portion of the tubes 101–106 (as viewed in FIG. 4) and shows, in perspective, the particular bending involved. This configuration continues through the bent portions 101*b* and 101*c* of the tube 101, i.e., around the opening 29, before the tubes 102–106 are bent back into the plane of the drawing as viewed in the right-hand portion of FIG. 4 immediately above the tube portion 101*d*. As a result, the tubes 101–106 form an inner row of tubes that defines the inner surface of the wall defining a portion of the opening 29 as better depicted in FIG. 6.

The group of the tubes 107–112 extends in a manner identical to the tubes 101–106 respectively with the exception that the former groups extends radially outwardly from the latter group around and relative to, the opening 29. The tubes 107–112 thus form another row of tubes adjacent the rows of tubes 101–106. The group of tubes 113–118 and the group of tubes 119–123 extend in a similar manner with the tubes 113–118 extending radially outwardly from the tubes 107–112 and the tubes 119–123 extending radially from the tubes 113–118. Tube 126, along with the remaining tubes (not shown in FIGS. 4–6) forming the wall 20 is not affected by the aforementioned bending and thus extends at the normal acute angle with respect to the horizontal for the entire width of the wall. Tubes 124 and 125 extend between the bent tube 123 and the straight tube 126 and are configured as shown in the drawing to provide a smooth transition between the aforementioned bent tubes and the straight tubes including tube 126. It is noted from FIG. 4 that as a result of the foregoing, the tubes 101, 107, 113, 119, 124 and 126 extend in the plane of the wall (or drawing) and that the remaining tubes of their respective groups extend from the plane, out of the plane, and back into the plane.

The tube 127 has a portion 127*a* which extends at the normal predetermined angle, a straight portion 127*b* which extends slightly downwardly from the horizontal as viewed in FIG. 4, a portion 127*c* which extends upwardly in a curved configuration, a portion 127*d* which extends at an angle slightly less than the normal angle, and a portion 127*e* which extends upwardly at the normal angle. Tubes 128–134 extend in a manner similar to that of the tube 127, with tube 128 extending adjacent to and radially outwardly from the tube 127; with tube 129 extending adjacent to and radially outwardly from tube 128, and so on.

The left-hand portion of the tubes 135–144 extend at the predetermined angle to the horizontal underneath the opening 29 as viewed in FIG. 4 and are bent out of the plane of the drawing as shown by the dashed lines to accommodate the tubes 127–134. The tubes 135–144 are then bent back into the plane of the drawing and each has a portion extending upwardly at an angle greater than the normal angle, and a portion extending at an angle slightly less than the normal angle, and the remaining portions extending at the normal angle as viewed in the right-hand side of FIG. 4. Tube 145, like the remaining tubes extending below the opening 29, is not affected by the aforementioned configurations and thus extends at the normal angle. It is noted from FIG. 7 that the tubes 127 and 135 thus form an inner row of tubes that defines the inner surface of the wall defining a portion of the opening 29.

It is apparent from the foregoing that each portion of every tube surrounding the opening as discussed above extends at an angle to the horizontal and, more particularly, at an acute angle upwardly in a direction from left-to-right in the drawings. This arrangement insures that water will drain from each tube and in a direction from right-to-left.

It is understood that the other burner opening 29 in the wall 20 and in any other boundary wall(s) forming the furnace section 10 can be formed in a manner identical to that described above using some of the tubes described in connection with FIGS. 4–6 and other tubes forming the particular wall. Also, the tubes referred to above can be bent in any known manner with the fins which normally extend between adjacent tubes being omitted along the bent tube portions. Further, a sealing assembly can be provided over the wall portions defining the burner openings 29 as needed to prevent leakage of the gases from the interior of the furnace.

Although not shown in the drawings of clarity of presentation, it is understood that suitable inlet and outlet headers, downcomers and conduits, are provided to place the tubes of each of the aforementioned walls and heat exchangers as well as the roof 80 in fluid communication to establish a flow circuit that will be described in detail later.

As shown in FIG. 1 a plurality of separators 84 are disposed in a parallel relationship adjacent the rear wall 41 of the heat recovery area 30 in the main flow circuit between the roof 80 and the primary superheater 52. The separators 84 operate in a known manner to separate the fluid from the roof 80 into a liquid and vapor. The vapor from the separators 84 is passed directly to the primary superheater 52 and the liquid is passed to a drain manifold and heat recovery circuitry for further treatment as also disclosed in the above-mentioned application.

In operation, feedwater from an external source is passed through the economizer tubes 50 to raise the temperature of the water before it is passed to inlet headers (not shown) provided at the lower portions of the furnace walls 18, 20 and 22. All of the water flows upwardly and simultaneously through the walls 18, 20, 21 and 22 to raise the temperature of the water further to convert at least a portion of same to vapor, before it is collected in suitable headers located at the upper portion of the vapor generator 10. The fluid is then passed downwardly through a suitable downcomer, or the like and then upwardly through the division walls 58 to add additional heat to the fluid. The fluid is then directed through the walls 40, 41, 42 and 44 of the heat recovery area 30 after which it is collected and passed through the roof 80. From the roof 80, the fluid is passed via a suitable collection header, or the like, to the separators 84 which separate the vapor portion of the fluid from the liquid portion thereof. The liquid portion is passed from the separators to a drain manifold and heat recovery circuitry (not shown) for further treatment and the vapor portion of the fluid in the separators 84 is passed directly into the primary superheater 52. From the latter, the fluid is spray attemperated after which it is passed to the platen superheater 56 and the finishing superheater 57 before it is passed in a dry vapor state to a turbine, or the like.

The combustion gases from the burners 28 in the intermediate furnace section 14 pass upwardly to the upper furnace section 16 and through the heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Several advantages result from the foregoing. For example, the use of the angularly extending tubes which wrap around to form the intermediate furnace section 14 enables the fluid to average out furnace heat unbalances and be passed through the boundary walls 18, 20 and 22 of the furnace section in one complete pass, thus eliminating the use of multiple passes and their associated mix headers and downcomers. Also, as a result of the angularly extending tubes, the furnace section can operate at a variable pressure without the need for a pressure reducing station and a relatively high mass flow rate and large tube size can be utilized over that possible with vertical tube arrangements. Further, the tube portions forming the front wall 18 and the rear wall 20 are bent in such a manner to form the openings 29 to enable them to be drained when needed.

It is understood that while the preferred embodiment described above includes a furnace having a substantially rectangular shaped cross-sectional area, other cross-sectional configurations, such as those having a circular or elliptical pattern, may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler," notwithstanding the fact that a true mathematical helex is not generated in a boiler which has a substantially rectangular cross-sectional area). It is also understood that the tubes may wrap around the furnace for more than one complete revolution, depending on the overall physical dimensions of the furnace. Also, although the burners 28 are shown extending through the front wall 18 and the rear wall 20, it is understood that they could extend through one or more of the sidewalls 22 or through only one of said walls, within the scope of the invention.

It is further understood that portions of the vapor generator have been omitted for the convenience of presentation. For example, insulation and support systems can be provided that extend around the boundary walls of the vapor generator as discussed above and a windbox, or the like, may be provided around the burners 28 to supply the air to same in a conventional manner. It is also understood that the upper end portions of the tubes 24 forming the upper furnace section 16 and heat recovery area 30 can be hung from a location above the vapor generating section 10 to accommodate thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

It is claimed:

1. A vapor generator comprising a plurality of tubes connected together and arranged to form at least a portion of the boundary walls of a gas-tight enclosure; at least one opening extending through at least one of said boundary walls; a series of adjacent tubes extending around at least a portion of said opening with one of said tubes of said series extending in the plane of said one boundary wall and the other tubes of said series respectively extending in additional planes spaced from each other and from said first plane; at least one additional series of adjacent tubes extending around said first series, with one of said tubes of said additional series extending in the plane of said one boundary wall and the other tubes of said additional series extending in said additional planes, respectively; said tubes extending at an acute angle with respect to a horizontal plane for the entire lengths of said tubes; burner means registering with said opening to apply heat to said enclosure; and means for passing fluid through said tubes to apply said heat to said fluid.

2. The vapor generator of claim 1 wherein said one tube of said additional series of tubes extends adjacent said one tube of the first-mentioned series of tubes.

3. The vapor generator of claim 2 wherein each of said other tubes of said additional series of tubes extends adjacent a corresponding tube of said first-mentioned series of tubes.

4. The vapor generator of claim 1 wherein said opening is circular and wherein portions of each tube of said first series of tubes extend for approximately one-half of the circumference of said opening.

5. The vapor generator of claim 4 wherein those portions of said other tubes of said first series of tubes not extending around said opening are bent back into the plane of said one boundary wall at a location spaced from said opening.

6. The vapor generator of claim 4 further comprising additional tubes extending for approximately the other half of the circumference of said opening.

7. The vapor generator of claim 6 wherein said latter additional tubes extend in the plane of said latter wall.

* * * * *